United States Patent [19]

Wong

[11] 3,990,706

[45] Nov. 9, 1976

[54] BOARD GAME APPARATUS

[75] Inventor: Walter W. Wong, Ottawa, Canada

[73] Assignee: The Raymond Lee Organization, Inc., a part interest

[22] Filed: July 21, 1975

[21] Appl. No.: 597,499

[52] U.S. Cl. ..... 273/131 K; 273/131 KN

[51] Int. Cl.[2] ..... A63F 3/00

[58] Field of Search ..... 273/131

[56] References Cited

UNITED STATES PATENTS

| | | | |
|---|---|---|---|
| 85,281 | 12/1868 | Carlin | 273/131 K |
| 797,063 | 8/1905 | Lamont | 273/131 AB |
| 1,420,230 | 6/1922 | Adams | 273/131 B |
| 3,359,003 | 12/1967 | Kass | 273/131 AD |

FOREIGN PATENTS OR APPLICATIONS

| | | | |
|---|---|---|---|
| 108,599 | 8/1917 | United Kingdom | 273/131 K |

*Primary Examiner*—Delbert B. Lowe

[57] ABSTRACT

A two player board game employs a playing board and two differently colored sets of playing pieces, each set having the same number of pieces. The board has a flat rectangular playing surface divided by a rectangular grid of lines into a plurality of like squares. The surface also carries four curved lines disposed on the surface adjacent but outside the corners. Each curved line is associated with a corresponding corner and connects the peripheral point of intersection on one side of the corner which is spaced by one intervening point of intersection from the vertex of the corner to the peripheral point of intersection on the other side of the corner which is spaced by one intervening point of intersection from the same vertex. The grid contains thirty-five squares arranged in a five by seven rectangular matrix. There are ten pieces in each set of pieces.

1 Claim, 2 Drawing Figures

BOARD GAME APPARATUS

SUMMARY OF THE INVENTION

The object of the invention is to provide a two player board game employing a playing board and playing pieces which in certain respects resembles checkers but which employs a much more complex strategy. To this end a rectangular grid of lines is disposed on the flat surface of a board to define a playing surface. The grid is made up of a first set of parallel equidistantly spaced lines which intersect a second set of parallel equidistantly spaced parallel lines, the lines in one set extending at right angles to the lines in the second set, thus forming a plurality of like squares. Typically, the grid employs thirty-five squares arranged with five squares along each of the ends and seven squares along each of the sides.

There are two sets of playing pieces which are differently colored, each set of pieces containing the same number of pieces. Typically each set contains ten playing pieces.

The purpose of the game is for each player to attempt to capture the pieces of the other player, the player who captures all of the pieces of the other player without losing all of his own pieces being the winner.

In this game, each player disposed at a corresponding end of the board places the pieces on each point of intersection on his half of the grid. Each player takes turns moving one piece at a time from one point of intersection to an adjacent point of intersection along a line of the grid. Each piece can be moved forward or sideways but not backward.

However, the board in addition to employing the grid employs four like curved lines. Each line is associated with a corresponding corner and is disposed outside of same. Each line connects the point of intersection on the periphery of one side of the corner which is spaced by one intervening point of intersection from the vertex of the corner to the point of intersection on the periphery of the other side of the corner which is spaced by one intervening point of intersection from the same vertex.

In order for one player to capture a piece of the other player, the one player must be able to move his attacking piece from a position on one of the two end points of any of the curved lines to the other of these end points, moving in either direction along the line. The piece to be attacked must be disposed on a point of intersection adjacent the other end point whereby the attacking piece jumps over the attacked piece onto a clear adjacent point of intersection. The attacked piece is then captured by having been jumped over in the same manner as in checkers. Single or multiple jumps and captures can be performed in the same manner as in checkers.

Thus this game is similar to checkers but is more complex and interesting.

DETAILED DESCRIPTION OF PREFERRED EMBODIMENTS

Figure 1:
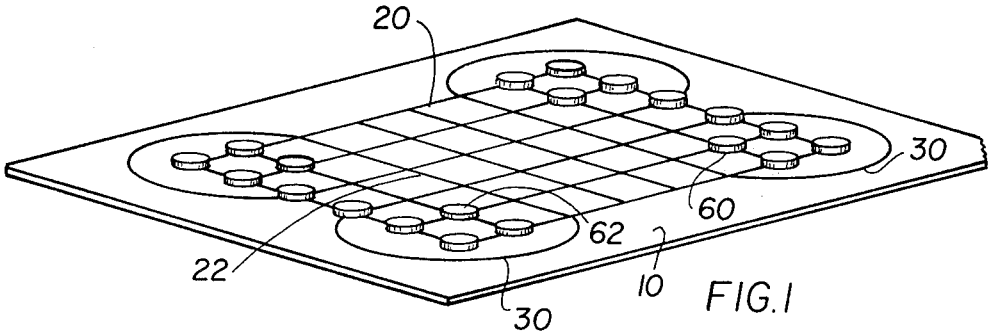
FIG. 1 is a perspective view of the playing board with the playing pieces in starting position.
Figure 2:
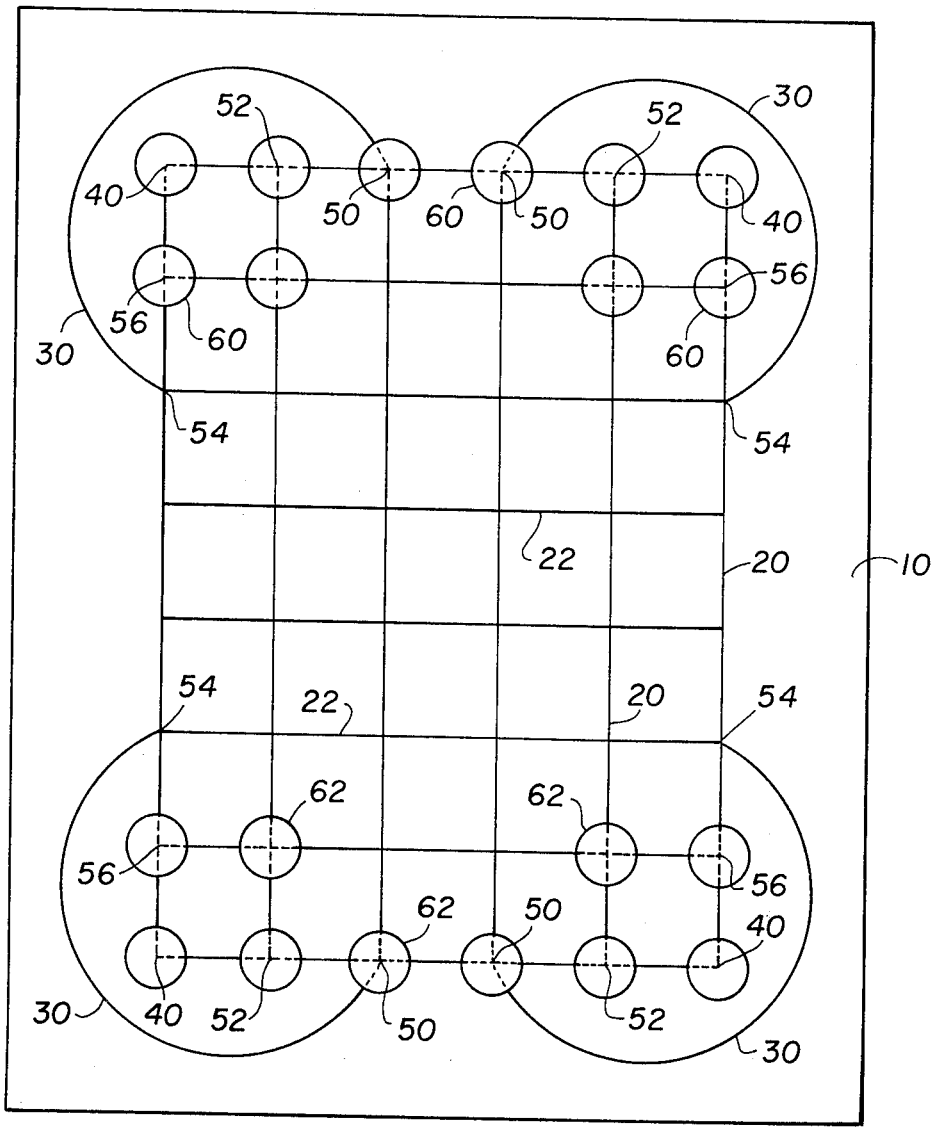
FIG. 2 is a top plan view of the arrangement of FIG. 1.

Referring now to FIGS. 1 and 2, a flat rectangular playing board 10 carries a rectangular grid formed by a first set of equidistantly spaced parallel vertical lines 20 which intersect a second set of equidistantly spaced parallel horizontal lines 22. There are eight horizontal lines and six vertical lines defining a five by seven matrix of thirty-five like squares. There are thus six points of intersection along each horizontal line and eight points of intersection along each vertical line.

In addition there are four like curved lines 30 defining arcs, each line 30 being disposed adjacent but outside a corresponding one of the four corners of the grid. Each corner has a vertex 40. Each line connects the point of intersection 50 along one side of the corresponding corner which is spaced by one intervening point of intersection 52 from vertex 40 to the point of intersection 54 along the other side of the corresponding corner which is spaced by one intervening point of intersection 56 from vertex 40.

There are ten playing pieces for each player arranged at the start as shown, the pieces 60 of one player being all of one color, the pieces 62 of the other player being all of another color. These pieces are typically checker like discs.

The game can then be played as previously described.

While this invention has been described with particular reference to the drawings, the protection sought is to be limited only by the terms of the claims which follow.

What is claimed is:

1. Game apparatus consisting of a flat rectangular playing board having a rectangular grid defined by a first set of eight parallel equidistantly spaced lines which intersect a second set of six parallel equidistantly spaced lines, the lines in each set extending at right angles to the lines of the other set, said grid further including four like curved lines, each curved line being located outside the corresponding corner and connecting that peripheral point of intersection on one side of the corresponding corner which is spaced by one intervening point on said one side from the vertex of the corresponding corner to that peripheral point of intersection on the other side of the corresponding corner which is spaced by one interviewing points on said other side from said vertex; and first and second sets of playing pieces, with each set having colored pieces of a single color, and with the two sets being colored differently from each other, there being ten pieces in each set.

* * * * *